United States Patent [19]

Haynes

[11] 4,257,721

[45] Mar. 24, 1981

[54] SYSTEM FOR PLACEMENT OF PILES INTO THE SEAFLOOR

[76] Inventor: Harvey H. Haynes, 690 Mesa Dr., Camarillo, Calif. 93010

[21] Appl. No.: 34,221

[22] Filed: Apr. 30, 1979

[51] Int. Cl.[3] ..... E02D 7/18; B63B 21/26

[52] U.S. Cl. ..... 405/227; 405/232; 405/224; 405/228; 114/295; 114/296

[58] Field of Search ..... 405/228, 224, 232, 203–208, 405/225, 226; 114/293–296

[56] References Cited

U.S. PATENT DOCUMENTS

| | | | |
|---|---|---|---|
| 2,994,202 | 8/1961 | Knapp et al. | 405/224 |
| 3,263,641 | 8/1966 | Stimson | 405/224 X |
| 3,431,879 | 3/1969 | Westling | 114/294 |
| 3,496,900 | 2/1970 | Mott et al. | 114/296 |
| 3,817,040 | 6/1974 | Stevens | 405/228 |
| 3,928,982 | 12/1975 | Lacroix | 405/224 |
| 4,086,866 | 5/1978 | Nixon | 114/295 |

FOREIGN PATENT DOCUMENTS

| | | | |
|---|---|---|---|
| 2265610 | 10/1975 | France | 114/296 |

*Primary Examiner*—Dennis L. Taylor
*Attorney, Agent, or Firm*—Richard S. Sciascia; Joseph M. St.Amand

[57] ABSTRACT

A system for placing piles into the seafloor by using pressure differential as the driving force. The pressure differential is created by a pump unit located either within or external to the pile. Operation of the pump unit which displaces both water and soil across a bulkhead section, enables the pile to be driven into and under the seafloor. A section of piling with a pump unit can operate as an uplift anchor, and multiple pumps on a large diameter piling can be embedded into the seafloor as a large foundation.

30 Claims, 8 Drawing Figures

SYSTEM FOR PLACEMENT OF PILES INTO THE SEAFLOOR

This application is related to copending U.S. Patent Application Ser. No. 034,220 for Pressure Differential Seafloor Corer-Carrier by Harvey H. Haynes, filed together herewith on Apr. 30, 1979, and commonly assigned.

BACKGROUND

This invention generally relates to pile placement and the like and more particularly to such applications as pinpiles, foundation piles, and uplift anchor piles. By using the device described herein, offshore platforms can be pinned to the seafloor with partial pile capacity within short time periods after founding the structure; foundation piles can provide stable (no settlement) footings for platforms for direction-oriented subsea equipment; and, uplift piles can be placed deep in or under the seafloor to provide high anchoring capacities. Also free standing piles, i.e. those standing without the aid of guide templates, can be placed in the seafloor.

DESCRIPTION OF THE PRIOR ART

State-of-the-art methods for pile placements are: surface-driven piles, underwater hammers, drilled-in piles and underwater vibrators. Surface driven piles using conventional pile hammers are limited to water depths of approximately 1000 feet (305 meters) because of the problems involved in handling extremely long piles. Underwater hammer placement has problems in placing the hammer on the pile and following (chasing) the pile as it sinks rapidly into soft seafloor soils. Drilled-in piles have the distinction of having the highest cost especially for deep ocean operations in water depths greater than 1,000 feet (305 meters). All of the aforementioned methods are dependent upon good weather conditions for successful operation. It is not uncommon for intial estimates of cost to be exceeded by a factor of two because of unfavorable weather conditions. Also, as the depths become greater, the above methods become less feasible and therefore more costly. The method of pile placement by use of vibrators is not as weather or depth dependent as the other methods, but it is soil-type dependent. Vibratory devices work well in noncohesive sediment (e.g. sand) but poorly in cohesive sediment (e.g. clay). Deep ocean locations principally have seafloor soils of clay and silt.

There are numerous prior-art techniques for the placement of piles in deep ocean, such as: dynamic impact (hammers), vibration, drilling, jetting, screw-in, jack-in, and explosive. Several of these concepts have already been discussed above. Jetting is a method of using high-pressure water to remove sediment in front or ahead of the pile as it is being driven in. Screw-in is a method that requires surface equipment to torque a large screw into the seafloor. Jack-in is a method of holding onto other piles so that a sufficient force can be developed to jack a new pile into the seafloor. The explosive method of driving piles into the seafloor uses explosive charges for the driving force.

U.S. Pat. Nos. 3,380,356 and 3,805,534 disclose the method of sinking a caisson or pile into the seafloor by having the upper end of the pile closed and then reducing the pressure inside the pile to create a hydrostatic-pressure driving force. A major limitation to this method is that once the interior of the pile is filled with sediment, the driving is stopped.

The present invention overcomes the foregoing limitations by employing a novel integral pump unit that can pump sediment as well as water to enable a pressure differential to be developed.

SUMMARY OF THE INVENTION

The present invention uses a pump unit which displaces both water and soil across a bulkhead section. During one stage of the pump operation, a pressure differential is created on the underside of the bulkhead and optimumly acts across the entire cross-sectional area of the pile. The driving force of the pressure differential acting on the cross-sectional area of the pile pushes the pile into the seafloor soil. The pile is capable of burying itself in the seafloor by the pump arrangement and driving principle disclosed herein.

This invention is capable of placing piles in seafloor sediments having a cohesive classification. Clays and silty-clay are typically found in the deep ocean.

BRIEF DESCRIPTION OF THE DRAWINGS

FIG. 5 illustrates the use of multiple pump units to install a large pile foundation on the seafloor for supporting raised platforms and the like.

Figure 1:
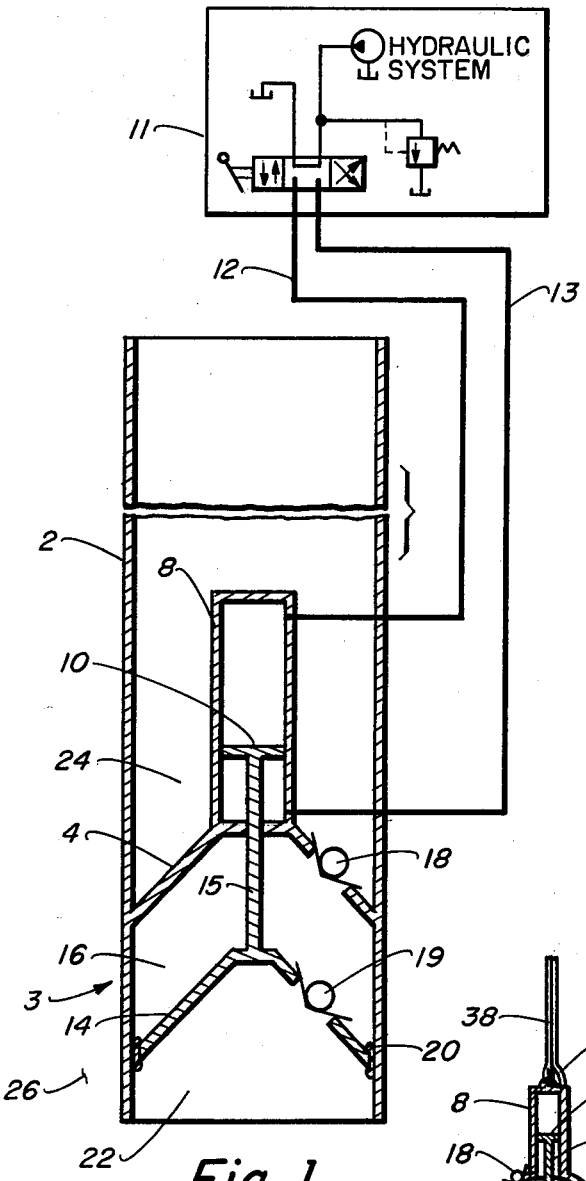
FIG. 1 shows a vertical cross-sectional view of a pile including a preferred embodiment of the invention.

FIGS. *6a, 6b* and *6c* illustrate the use of the present invention as an up-lift anchor, and shows the placement of a pile unit on the seafloor, driving the pile into the seafloor, and setting the anchor.

DESCRIPTION OF THE PREFERRED EMBODIMENTS

In various figures of drawing, like reference numerals refer to like parts.

Referring to FIG. 1, a pile casing 2 is shown having a pump unit integral therewith and located near the leading-end (tip) 3 thereof. This embodiment develops a maximum driving force of pile 2 into the seafloor. Bulkhead 4, which is a water-tight, pressure-resistant shell, is located near the leading-end of pile 2. Attached to bulkhead 4 is an hydraulic cylinder 8 which contains a piston 10. Piston 10 is moved in a reciprocating manner by hydraulic system 11 which is connected to cylinder 8 via hydraulic lines 12 and 13. This movement of piston 10 is transferred by ram-rod 15 to a diaphram 14, located beneath bulkhead 4, to pump water and soil from cavity 22 at the leading-end of pile 2. Material (i.e. soil and water) in area 16 between bulkhead 4 and diaphram 14 is squeezed through one-way valve(s) 18 into the upper cavity 24 during the up-stroke of piston 10. Cavity 24 is open at the top of pile 2 to the ambient environment 26. On the down stroke of piston 10, which moves diaphram 14 downward, material in cavity 22 is squeezed through one-way valve(s) 19 into cavity 16. The steps are then repeated. Check valves that can be reversed can be used for one-way valves 18 and 19 in order that a pile can be backed out of the seafloor, if desired, under certain circumstances. Seal 20 aids in the pumping efficiency of the unit.

Operation of the pump, which consists of cylinder 8, piston 10, hydraulic system 11 and ram 15, creates a hydrostatic driving force in the following manner: when ram 15 is fully extended and just starts on the up-stroke, a void is created on the bottom side of diaphram 14. The pressure inside this void can be less than atmospheric pressure, which will result in a pressure-differential force equal to the weight of all material above the void. This weight includes the pile, seafloor soil, water and air. The weight of air can be neglected because of its small magnitude compared to the other weights. Once a void is created, one of two actions can occur: the pile can move down or the water and soil in cavity 22 can move up to fill the void. As long as the magnitude of the pressure differential does not exceed the bearing strength of the seafloor sediment, the pile will move down. Tests have shown that even when the bearing strength of the sediment is exceeded and the sediment moves up, the pile also moves down simultaneously but to a lesser magnitude. Downward movement will decrease as skin-friction increases.

Figure 2:
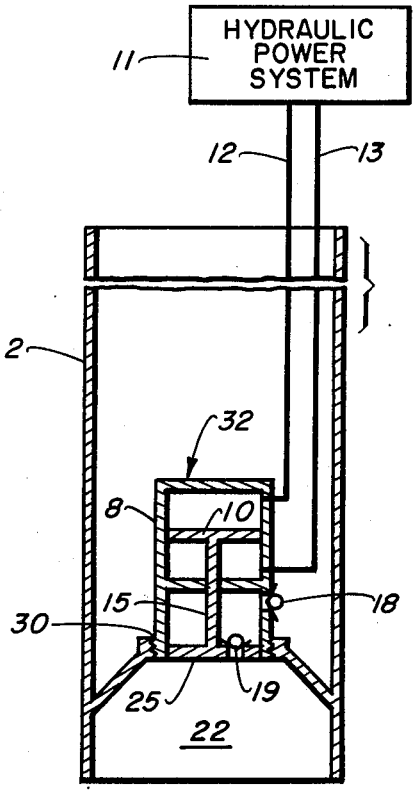
FIG.2 shows another embodiment of the invention with a removable pump unit.

Another embodiment of the invention is shown in FIG. 2. The workings of the pump and hydraulic system 11 are the same as in FIG. 1. However, diaphram 25 is smaller than the inside diameter of the pile 2. This affects the magnitude of the driving force because the area over which the pressure differential acts has been reduced. Also, a coupling 30 allows for the retrieval of the pump assembly 32 after the pile has been placed; the pump assembly can be retrieved from inside the pile. The embodiment of FIG. 1 can also be equipped with a decoupling device, if desired, for pump retrieval.

Figure 3:
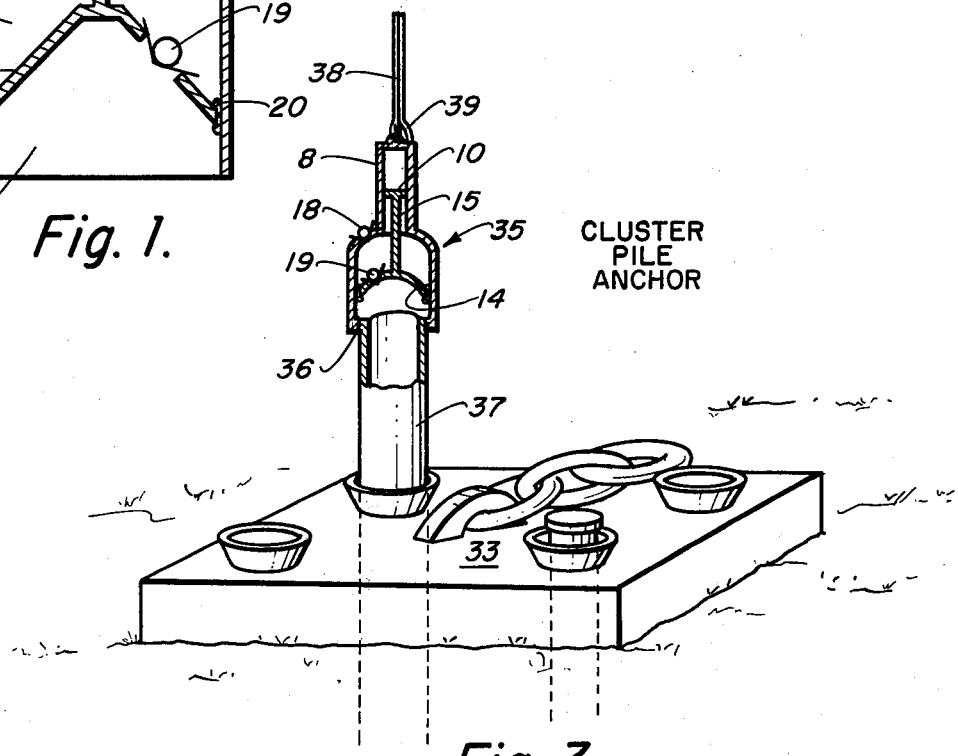
FIG. 3 illustrates a cluster pile anchor.

There are several advantages that are readily apparent from this self-driving pile invention. When the pump is used external to the pile, i.e. on top as shown in FIG. 3, a pile-driving hammer is not required for initial setting of the piles. The initial setting of a pile is a difficult stage for a hammer because the sediment beneath the pile is usually so weak that each blow can cause the pile to "run." The hammer may not be able to follow the pile so they separate and the delicate task of joining the two will need to be accomplished again. FIG. 3 shows a cluster pile platform 33 being secured to the seafloor by means of piles 37 driven into the seafloor using a pump unit 35 removably attached to the top of the piles. This method permits anchor installation at deep ocean depths. The pressure-differential pump unit assembly 35 can be attached at 36 to the top of a pile 37 by mechanical means with a hydraulic release or by gravity forces with a rubber-type seal. The pile will not need a templet along its length as is the case in a hammer operation because pile vibrations are not set up by the pressure-differential pump. A cable 38 to a surface vessel is attached to the top of the pump unit for lowering the pump unit 35 with the pile and for retrieving the pump unit when decoupled from the pile. Hydraulic lines 39 can also be attached to cable 38.

Figure 4:
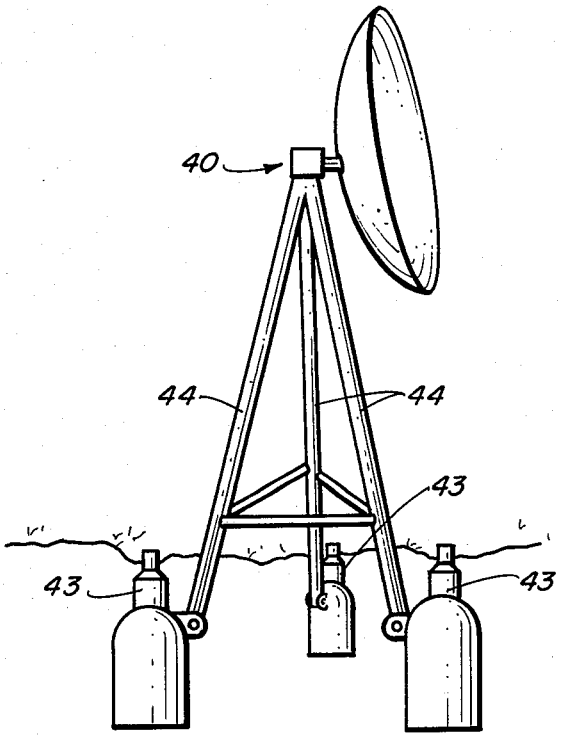
FIG. 4 shows a hydrophone installation on the seafloor using the present invention for driving the legs thereof into the seafloor and for adjusting the orientation.
Figure 5:
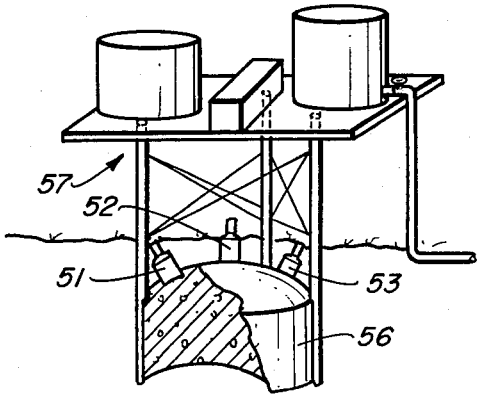

Stable, load-bearing foundations can be created as shown in FIGS. 4 and 5. A negatively buoyant object can experience considerable settlement on the seafloor. Settlement problems can be overcome by sinking each leg or footing of a foundation into the seafloor until stronger sediments are encountered. For the application as shown in FIG. 4, the vertical and horizontal orientation of a hydrophone 40, for example, can be manipulated by independent operation of each pump unit 43 which will selectively drive the legs 14 into the seafloor until the hydrophone is properly oriented and level.

Multiple pumps 51, 52 and 53 on a large pile foundation 56, such as shown in FIG. 5, for example, offer the advantage of also being able to remove the foundation from the seafloor. Foundation 53 can be used to support a superstructure 57, such as that shown in the drawing, above the seafloor. By reversing the direction of the valves 18 and 19, shown in FIG. 1, a pressure higher than ambient can be created inside the foundation to lift the structure. If desired, a second set of valves, which operate in reverse of valves 18 and 19, can be used instead of merely reversing valves 18 and 19, whichever is most convenient. One set of valves being allowed to function only on driving downward and the other set of valves functioning only when lifting the foundation.

Figure 6A:
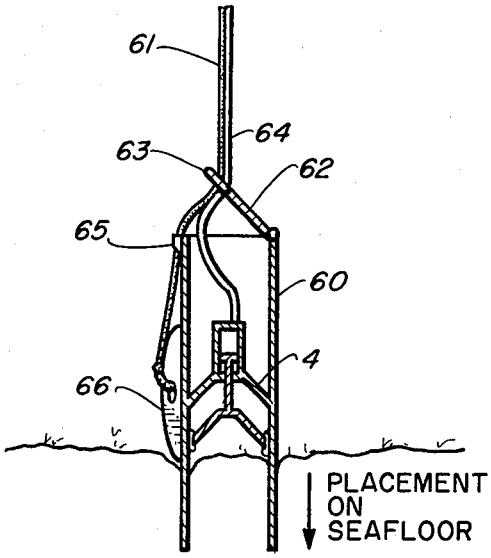
Figure 6B:
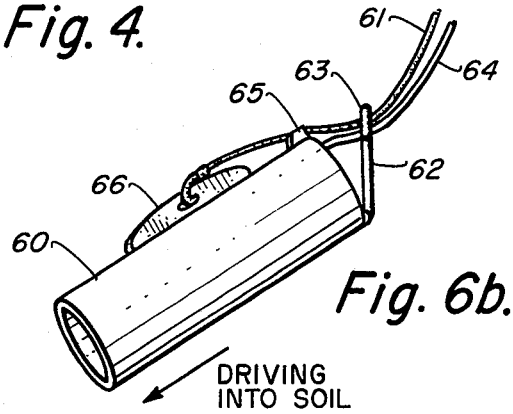
Figure 6C:
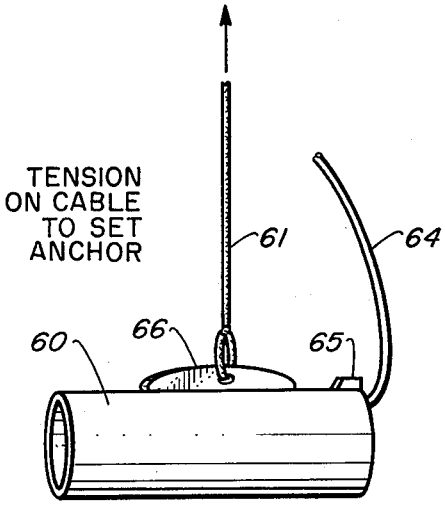

Piles can also be completely driven under the seafloor. This technique is shown in FIGS. 6*a*, 6*b* and 6*c*, where a pile is being placed under the seafloor for use as an uplift anchor. In this arrangement the bulkhead 4 is placed at midlength of the pile 60 to act as a stiffener when uplift forces act on the anchor. The pile is placed vertically on the seafloor, as shown in FIG. 6*a*, by proper rigging of the liftline 61. Arm 62 is a hydraulic cylinder that actuates a gripper 63 which holds the liftline 61. The gripper 63 holds the liftline 61 so that the pile 60 hangs vertically. The pump system is operated by hydraulic lines 64 from the surface to create a pressure-differential and drive the pile into and under the seafloor. The pile will deviate from the vertical, as shown in FIG. 6*b*, because of drag produced by the liftline guides 65 and the padeye 66. A sensor that monitors inclination is used to inform the operator when to stop the pump unit driving the pile. Gripper 63 is then hydraulically released and the liftline 61 is tensioned to set the pile 60 in the horizontal position, as shown in FIG. 6*c*. This example is used only to illustrate the advantage of being able to drive a pile under the seafloor.

Another advantage of the invention is that the soil around the outside periphery of the pile is not disturbed as the pile is driven; whereas, water jetting methods for pile placement do greatly disturb the soil and harm the skin-friction between the soil and a pile.

Various accessory hardware systems and techniques can be used to loosen soil in cavity 22 at the pile tip, FIGS. 1, 2 and the like. Small water jets or rotating blades can reduce the soil strength in preparation for pumping. If desired, a grill can be placed over the open end of a pile to break up soil and also to function as a sieve to prevent rocks from entering the pile.

Hydraulic system 11 can be made from numerous state-of-the-art components. Fast return or quick exhaust systems will permit a high concentration start for the up-stroke. Servo systems can be used to automatically reverse the direction of stroke. This would be of great advantage should an obstruction prevent the full stroke. Once a specified maximum hydraulic pressure is attained on one side of the piston, the stroke direction is changed. Partial strokes will still create a pressure differential that will cause the pile to be driven.

Another advantage of the invention is that a totally self-contained system, independent of tether lines, etc., to the surface, can be assembled to drive itself into or under the seafloor. Batteries, etc., for the power source and an electro-hydraulic converter for the hydraulic pressure source can be mounted in or on the pile to operate remotely on or under the seafloor.

Obviously, many modifications and variations of the present invention are possible in light of the above teachings. It is, therefore, to be understood that within the scope of the appended claims the invention may be practiced otherwise than as specifically described.

What is claimed is:

1. A self-driving pile assembly, comprising:

a. a hollow tubular pile casing open at each end thereof; one end thereof being the leading-end of the pile which is driven into a seafloor;

b. a watertight, pressure-resistant bulkhead spanning the interior walls of said pile casing at a position between the open ends thereof and separating the interior of said housing casing into upper and lower chambers;

c. a pressure-differential pump unit mounted centrally to said bulkhead for driving said pile casing into the seafloor;

d. said pump unit including means for pumping water and sediment from said lower chamber through the pump unit into and through said upper chamber whereby a pressure differential is created to force said pile casing into the seafloor;

e. said pump unit comprising:

an hydraulic cylinder containing piston means; said piston means operable to be moved in a reciprocating manner;

means connected to said hydraulic cylinder for operating said piston means in said reciprocating manner;

a diaphram means movably mounted beneath said hydraulic cylinder;

a ram-rod means slidably passing through one end of said hydraulic cylinder and connecting said piston means to said diaphram means to impart movement from said piston means to said diaphram means;

at least one check valve in said bulkhead and at least one check valve in said diaphram means, respectively, operable to allow water and sediment from the seafloor to pass therethrough from said lower pile casing chamber to said upper pile casing housing chamber when said pile assembly is to be moved downward into the seafloor.

2. A device as in claim 1 wherein said pump unit also includes means for reversing the flow of water and sediment therethrough for backing said pile casing out of the seafloor.

3. A device as in claim 1 wherein said pressure-differential pump unit is mounted toward the leading end of said pile casing.

4. A device as in claim 1 wherein said pump unit is removably mounted on said bulkhead for retrieval and reuse.

5. A device as in claim 1 wherein said pump unit also includes means for reversing the flow of water and sediment therethrough for backing said pile casing out of the seafloor.

6. A device as in claim 5 wherein said means for reversing the flow of water and sediment through said pile casing comprises a means for reversing the operation of said check valves in both said bulkhead and said diaphram means, respectively.

7. A device as in claim 1 wherein said diaphram means slideably fits and spans the interior of the lower chamber of said pile casing.

8. A device as in claim 1 wherein said means connected to said hydraulic cylinder for operating said piston in a reciprocating manner comprises an hydraulic power system.

9. A device as in claim 4 wherein said hydraulic power system is located remote from said pile assembly.

10. A self-driving pile assembly, comprising:

a. a hollow tubular pile casing open at each end thereof; one end thereof being the leading end of the pile which is driven into a seafloor;

b. at least one pressure differential pump unit mounted on said pile casing for driving said pile casing into the seafloor;

c. said pump unit including means for pumping water and sediment from the leading end of said pile casing, through the pile casing and expelling said water and sediment therefrom, said pump unit creating a pressure differential between the leading end of said pile casing and the environment surrounding said pile casing causing said pile casing to be driven into the seafloor;

d. said pump unit comprising:

a cylindrical housing open at the bottom end thereof and operable to be mounted at the top end of said pile casing;

a watertight, pressure-resistant bulkhead spanning the top end of said housing; a hydraulic cylinder containing a piston means mounted centrally to the top of said bulkhead; said piston means operable to be moved in a reciprocating manner;

means connected to said hydraulic cylinder for operating said piston means in said reciprocating manner;

a diaphram means slideably mounted beneath said bulkhead and the bottom end of said pump housing and spanning the interior walls of said cylindrical housing;

a ram-rod means slideably passing through one end of said hydraulic cylinder and connecting said piston means to said diaphram means to impart movement from said piston means to said diaphram means;

at least one check valve in said bulkhead and at least one check valve in said diaphram means, respectively, operable to allow water and sediment to pass therethrough from the interior of said cylindrical housing and said pile casing to be expelled into the surrounding environment when said pile casing is to be moved downward into the seafloor.

11. A device as in claim 10 wherein means is provided for removably mounting said pump unit on said pile casing.

12. A device as in claim 11 wherein said pump unit is mounted on the top end of said pile casing.

13. A device as in claim 10 wherein said pump unit is mounted on the top end of said pile casing.

14. A device as in claim 10 wherein said pump unit also includes means for reversing the flow of water and sediment therethrough for backing said pile casing out of the seafloor.

15. A device as in claim 13 wherein said pump unit also includes means for reversing the flow of water and sediment therethrough for backing said pile casing out of the seafloor.

16. A device as in claim 13 wherein said means connected to said hydraulic cylinder for operating said piston in a reciprocating manner comprises an hydraulic power system.

17. A device as in claim 16 wherein said hydraulic power system is located remote from said pile assembly.

18. A device as in claim 10 wherein a large diameter pile casing is used as a foundation in the seafloor for supporting a superstructure and a plurality of pump units are used for driving said pile into the seafloor.

19. A device as in claim 14 wherein one said pile assembly is used on each leg of a superstructure having a plurality of supporting legs whereby the orientation of said superstructure can be manipulated by the independent operation of each said pump unit attached to individual legs thereof.

20. A self-driving anchor assembly, comprising:

a. a hollow tubular pile casing open at each end thereof; one end thereof being the leading-end of the anchor assembly which is driven into a seafloor;

b. a watertight, pressure-resistant bulkhead spanning the interior walls of said pile casing at a position inbetween the open ends thereof and separating the interior of said housing casing into upper and lower chambers;

c. a pressure-differential pump unit mounted centrally to said bulkhead for driving said pile casing into the seafloor;

d. said pump unit including means for pumping water and sediment from said lower chamber through the pump unit into sand through said upper chamber whereby a pressure-differential is created to force said pile casing into the seafloor;

e. a liftline means attached approximately midway along the length of said pile casing;

f. a rigging means which includes a gripper means for initially positioning said liftline means lengthwise along said pile casing for properly guiding the anchor assembly into and under the seafloor; said gripper means being operable to release said liftline means from its initial position when said anchor assembly is horizontally positioned beneath the seafloor and permit said liftline means to be positioned from its place of attachment midway along the length of said pile casing for setting said anchor assembly for operation use as an uplift anchor.

21. A device as in claim 20 wherein said gripper means is a remotely operated gripper mechanism.

22. A device as in claim 20 wherein means is provided to cause said anchor assembly to deviate as it is driven into the seafloor from an initial substantially vertical position when first entering the seafloor to a substantially horizontal position at a desired depth beneath the seafloor.

23. A device as in claim 22 wherein said means for causing said anchor assembly to deviate in its path as it is driven into the seafloor includes liftline guides mounted on said pile casing.

24. A cluster pile anchor operable for installation on and being secured to the seafloor, comprising:

a. an anchor platform having a plurality of vertical openings therein through which a respective plurality of piles are operable to be driven;

b. a plurality of hollow, open ended, self-driving pile casings being positioned in said respective plurality of vertical openings in said anchor platform;

c. a removable pressure-differential pump means attached to the upper end of each of said plurality of self-driving piles;

d. each said pressure-differential pump means comprising:

a section of cylindrical casing open at either end thereof; one end of said section being the intake end of said pump housing and the other end being the expulsion end thereof;

a watertight, pressure-resistance bulkhead spanning the interior walls of said casing at a position inbetween the opposite ends thereof and separating the interior of said casing into upper and lower chambers;

an hydraulic cylinder containing a first piston means mounted centrally to said bulkhead; said first piston means operable to be moved in a reciprocating manner;

means connected to said hydraulic cylinder for operating said first piston means in said reciprocating manner;

a second piston means movably mounted between said bulkhead and the intake end of said section of cylindrical pump means casing;

a ram-rod means slideably passing through one end of said hydraulic cylinder and connecting said first piston means to said second piston means to impart movement from said first piston means to said second piston means;

flow control means in said bulkhead and in said second piston means, respectively, operable to allow water and sediment to pass therethrough only in a direction from said lower chamber to said upper chamber when water and soil sediment is to be moved from the intake end and expelled from the expulsion end of said pump unit causing said open ended pile casing to be driven into the seafloor; said flow control means also being operable to allow water and sediment to pass therethrough in a reverse direction only from said upper chamber to said lower chamber;

e. means on the upper end of each said pile casing for securely holding down said anchor platform to the seafloor;

f. attachment means on said anchor platform for securing an item to be anchored to the seafloor.

25. A device as in claim 24 wherein said means connected to said hydraulic cylinder for operating said piston in a reciprocating manner comprises a hydraulic power system.

26. A device as in claim 25 wherein said hydraulic power system is located remote from said pile assembly.

27. A pressure differential pump unit for pumping water and soil sediment, comprising:

a. a section of cylindrical casing open at either end thereof; one end of said section being the intake end of said pump housing and the other end being the expulsion end thereof;

b. a watertight, pressure-resistant bulkhead spanning the interior walls of said casing at a position inbetween the opposite ends thereof and separating the interior of said casing into upper and lower chambers;

c. an hydraulic cylinder containing a first piston means mounted centrally to said bulkhead; said first piston means operable to be moved in a reciprocating manner;

d. means connected to said hydraulic cylinder for operating said first piston means in said reciprocating manner;

e. a second piston means movably mounted between said bulkhead and the intake end of said section of casing;

f. a ram rod means slideably passing through one end of said hydraulic cylinder and connecting said first piston means to said second piston means to impart movement from said first piston means to said second piston means;

g. flow control means in said bulkhead and in said second piston means, respectively, operable to allow water and sediment to pass therethrough only in a direction from said lower chamber to said upper chamber when water and soil sediment is to be moved from the intake end and expelled from the expulsion end of said pump unit; said flow control means also being operable to allow water and sediment to pass therethrough in a reverse direction only from said upper chamber to said lower chamber.

28. A device as in claim 27 wherein said means connected to said hydraulic cylinder for operating said piston in a reciprocating manner comprises an hydraulic power system.

29. A device as in claim 28 wherein said hydraulic power system is located remote from said pile assembly.

30. A self-driving pile assembly, comprising:

a. a hollow tubular pile casing open at each end thereof; one end thereof being the leading-end of the pile which is driven into a seafloor;

b. at least one pressure differential pump unit mounted on said pile casing for driving said pile casing into the seafloor;

c. said pump unit including means for pumping water and sediment from the leading end of said pile casing, through the pile casing and expelling said water and sediment therefrom, said pump unit creating a pressure-differential between the leading end of said pile casing and the environment surrounding said pile casing causing said pile casing to be driven into the seafloor;

d. said pump unit comprising:

a section of cylindrical casing open at either end thereof; one end of said section being the leading edge of said pump housing and the other end being the expulsion end thereof; a watertight, pressure-resistant bulkhead spanning the interior walls of said casing at a position inbetween the opposite ends thereof and separating the interior of said casing into upper and lower chambers;

an hydraulic cylinder containing a first piston means mounted centrally to said bulkhead; said first piston means operable to be moved in a reciprocating manner;

means connected to said hydraulic cylinder for operating said first piston means in said reciprocating manner;

a second piston means movably mounted between said bulkhead and the leading edge of said section of casing;

a ram-rod means slideably passing through one end of said hydraulic cylinder and connecting said first piston means to said second piston means to impart movement from said first piston means to said second piston means;

flow control means in said bulkhead and in said second piston means, respectively, operable to allow water and sediment to pass therethrough only in a direction from said lower chamber to said upper chamber when said pile assembly is to be moved downward into the seafloor; said flow control means being operable to allow water and sediment to pass therethrough only in a direction from said upper chamber to said lower chamber when said pile assembly is to be moved back out of the seafloor;

operation of said first and second pump pistons by means of said hydraulic system with said flow control means functioning so as to allow water and sediment to pass only upward through said pump unit causing said pile assembly to move downward into the seafloor, and operation of said first and second pump pistons with said flow control means functioning so as to allow water and sediment to pass only downward through the pump unit causing said pile assembly to back up out of the seafloor.

* * * * *